US006940029B1

(12) United States Patent
Wang et al.

(10) Patent No.: US 6,940,029 B1
(45) Date of Patent: Sep. 6, 2005

(54) CONTINUOUSLY ILLUMINATED ROCKER SWITCH HAVING SEPARATE CIRCUIT ILLUMINATING STRUCTURE TO INDICATE CLOSED SWITCH POSITION

(75) Inventors: Pai-Shan Wang, Tainan (TW); Chia-Fu Tseng, Tainan (TW)

(73) Assignee: Shin Chin Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 10/890,187

(22) Filed: Jul. 14, 2004

(51) Int. Cl.[7] ..... H01H 9/00
(52) U.S. Cl. ..... 200/315
(58) Field of Search ..... 200/307–317, 200/302.2, 339, 553–574, 320.3

(56) References Cited

U.S. PATENT DOCUMENTS 3,601,567 A * 8/1971 Shah ..... 200/314
4,667,073 A * 5/1987 Osika ..... 200/317
4,758,724 A * 7/1988 Osika ..... 200/315
5,053,591 A * 10/1991 Theurer ..... 200/315
5,903,107 A * 5/1999 Wade ..... 200/315 X
6,013,885 A * 1/2000 Kowalczyk ..... 200/315
6,103,982 A * 8/2000 Chien ..... 200/315
6,388,220 B1 * 5/2002 Sasaki et al. ..... 200/315 X
6,444,930 B1 * 9/2002 MacDonald et al. ..... 200/302.3
6,465,753 B1 * 10/2002 Wang ..... 200/302.3 X
6,576,855 B2 * 6/2003 Levendis et al. ..... 200/339
6,621,025 B2 * 9/2003 Yei et al. ..... 200/315
6,734,381 B2 * 5/2004 Mayo et al. ..... 200/329

* cited by examiner

*Primary Examiner*—James R. Scott
(74) *Attorney, Agent, or Firm*—Rosenberg, Klein & Lee

(57) ABSTRACT

A switch is equipped with an indicating lamp assembly, which is secured in a control of the switch, and which includes a first lamp, and a second lamp respectively used for helping people find the switch in the dark, and for indicating that the switch has been switched on; the first and the second lamps have a common leg, and a respective second leg; the common leg is electrically connected with a terminal of the switch; the second leg of the first lamp touches another terminal of the switch; the second leg of the second lamp will touch yet another terminal of the switch as soon as the switch is switched on therefore the second lamp will begin to produce light as soon as the switch is switched on for allowing power to be supplied through it.

2 Claims, 6 Drawing Sheets

CONTINUOUSLY ILLUMINATED ROCKER SWITCH HAVING SEPARATE CIRCUIT ILLUMINATING STRUCTURE TO INDICATE CLOSED SWITCH POSITION

BACKGROUND OF THE INVENTION

1. Field of the Invention

The present invention relates to a switch, more particularly one, which is equipped with an indicating lamp assembly having first and second lamps that are respectively used for helping people find the switch in the dark, and for indicating that the switch has been switched on.

2. Brief Description of the Prior Art

Switches are available that are equipped with lamps used for helping people find the switches in the dark. And, switches are available that are equipped with indicating lamps, which will begin to produce light as soon as the switches are switched on such that people can be informed that power is on.

Referring to FIGS. 5 and 6, a conventional switch includes a housing 31, a control element 32, an indicating lamp 33, first, second, and third terminals 34, 35, and 36, and a spring-loaded metallic member 37. The control element 32 is pivoted on an upper portion of the housing 31 such that the switch 3 can be switched from a closed position to an open position, and vice versa by means of the control element 32; when the switch 3 is in the closed position, power can be supplied through it. The first, the second, and the third terminals 34, 35, and 36 are secured to a lower portion of the housing 31, and project into the housing 11 at upper ends thereof. A metallic conducting element 341 is disposed in the housing 31, and connected with the first terminal 34. The second terminal 35 has a conducting plate 351 pivoted to the upper end thereof. The spring-loaded metallic member 37 is secured on a lower side of the control element 32 to touch the conducting plate 351 such that the control element 32 can cause the conducting plate 351 to change angle together with it; the switch 3 will be closed as soon as the conducting plate 351 comes into contact with the third terminal 36 as shown in FIG. 5; the switch 3 will be opened as soon as the conducting plate 351 is away from the third terminal 36 as shown in FIG. 4.

The indicating lamp 33 is disposed in the control element 32, and used for indicating that the switch 3 is in the closed position. The indicating lamp 33 has first and second legs 331 and 332. Furthermore, a load 38 is provided, which is connected with both the second leg 332 and the spring-loaded metallic member 37 at two ends. And, the first leg 331 is arranged in such a position that when the switch 3 is switched to the closed position, the first leg 331 will come into contact with the metallic conducting element 341, as shown in FIG. 5, and such that when the switch 3 is switched to the open position, the first leg 331 will be away from the metallic conducting element 341.

Consequently, the indicating lamp 33 will be on as soon as the switch 3 is switched to the closed position, indicating that power has been switched on. And, the indicating lamp 33 will be off when the switch 3 is in the open position.

However, no indicating lamp assembly for a switch is available that includes first and second lamps respectively used for helping people find the switch in the dark, and for indicating that the switch is switched on.

SUMMARY

It is a main object of the present invention to provide an improvement on a switch to overcome the above disadvantages.

The switch of the present invention includes a switch main body, a control, and an indicating lamp assembly, which is secured in the control, and which includes a first lamp, and a second lamp respectively used for helping people find the switch in the dark, and for indicating that the switch has been switched on. The first and the second lamps have a common leg, and a respective second leg. The common leg is electrically connected with a terminal of the switch. The second leg of the first lamp touches another terminal of the switch while the second leg of the second lamp will touch yet another terminal of the switch as soon as the switch is switched on. Therefore, when the switch is in the off (open) position, the first lamp will produce light, but the second one won't. And, the second lamp will begin to produce light as soon as the switch is switched to the closed position where it allows power to be supplied through it.

BRIEF DESCRIPTION OF THE DRAWINGS

The present invention will be better understood by referring to the accompanying drawings, wherein.

DETAILED DESCRIPTION OF THE PREFERRED EMBODIMENTS

Referring to FIGS. 1 to 4, a preferred embodiment of a switch of the present invention includes a switch main body 1, and an indicating lamp assembly 2.

Figure 1:
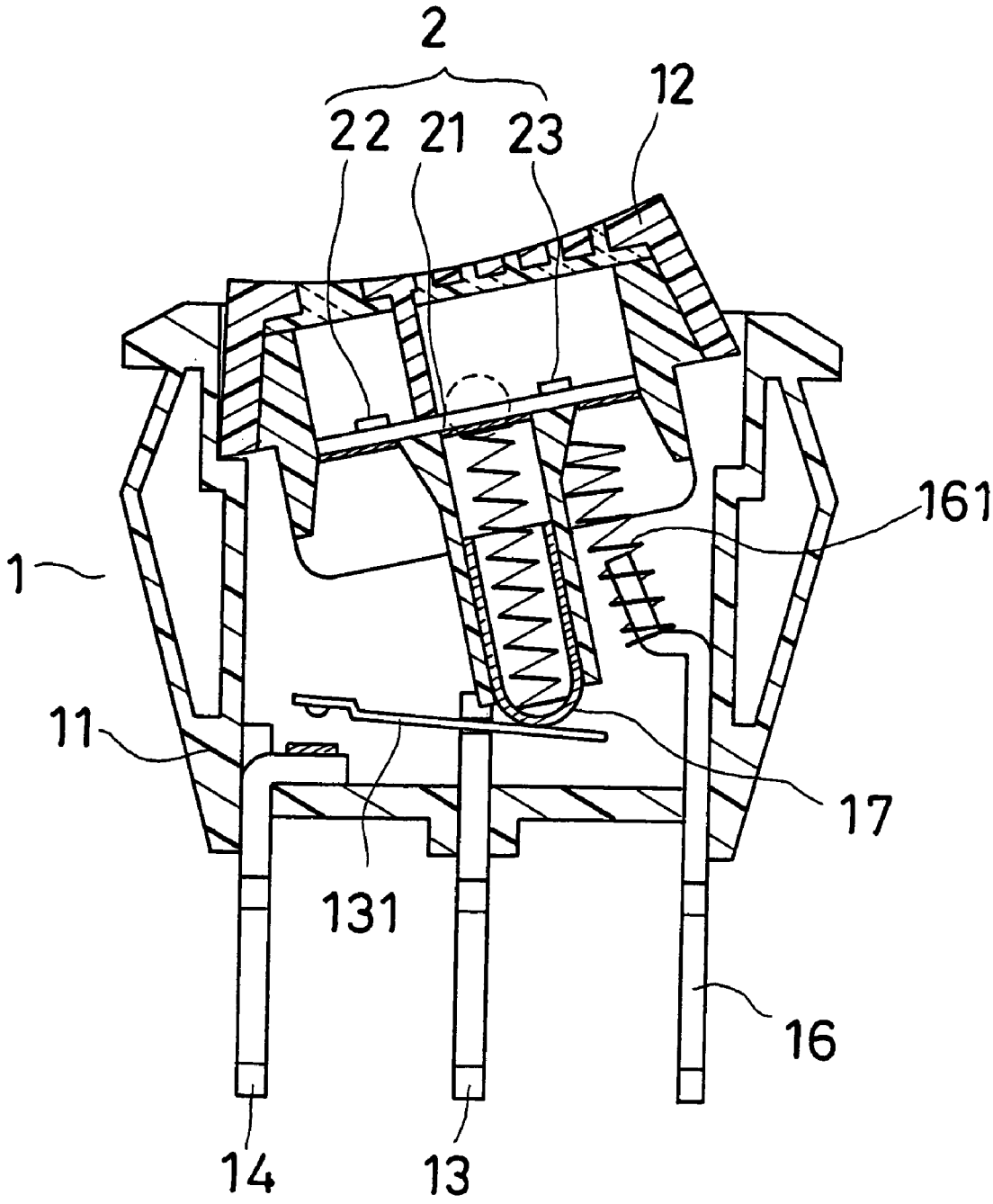
FIG. 1 is a vertical section of the switch of the present invention in the open position, which is perpendicular to the front side.
Figure 3:
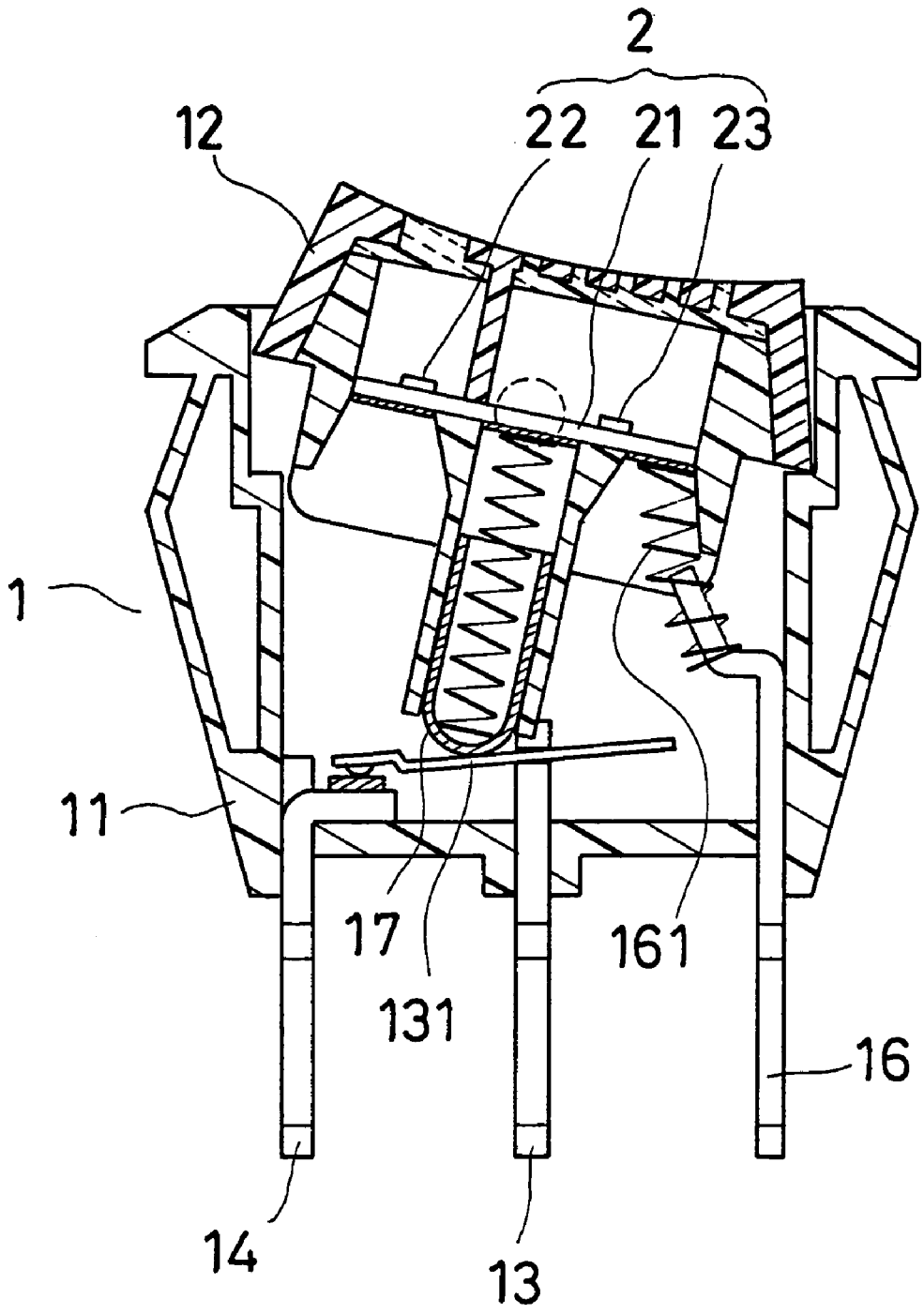
FIG. 3 is a vertical section of the switch of the present invention in closed position, which is perpendicular to the front side.

The main body 1 includes a housing 11, a control element 12, first, second, third, and fourth terminals 13, 14, 15, and 16, and a spring-loaded metallic member 17. The control element 12 is pivoted on an upper portion of the housing 11 such that the switch main body 1 can be switched from a closed position to an open position, and vice versa by means of the control element 12. When the switch main body 1 is in the closed position, power can be supplied through it. The first, the second, the third, and the fourth terminals 13, 14, 15, and 16 are secured to a lower portion of the housing 11 with upper ends thereof projecting into a holding room of the housing 11. The first terminal 13 has a conducting plate 131 pivoted to the upper end thereof for separable contact with the second terminal 14. The switch main body 1 will be closed when the conducting plate 131 touches the second terminal 14, as shown in FIG. 3, providing a conductive path from terminal 13 to terminal 14. The main body 1 will be opened when the conducting plate 131 is moved away from the second terminal 14, as shown in FIG. 1.

The spring-loaded metallic member 17 is secured on a lower side of the control element 12, and touches the conducting plate 131 such that the conducting plate 131 will change orientation together with the control element 12 when the control element 12 is used.

Furthermore, elastic conducting elements 151 and 161 are respectively fitted on the upper ends of the third and the fourth terminals 15 and 16 at lower ends thereof.

The indicating lamp assembly 2 includes a circuit board 21, and first and second indicating lamps 22 and 23 on the circuit board 21, which have a common leg, and each of which has a second leg; the first indicating lamp 22 is used for helping people find the present switch in the dark while the second indicating lamp 23 is used for indicating that the present switch is in the closed position for allowing power to be supplied through it. And, electric resistances 221 and 231 are respectively connected with the first and the second indicating lamps 22 and 23.

Figure 2:
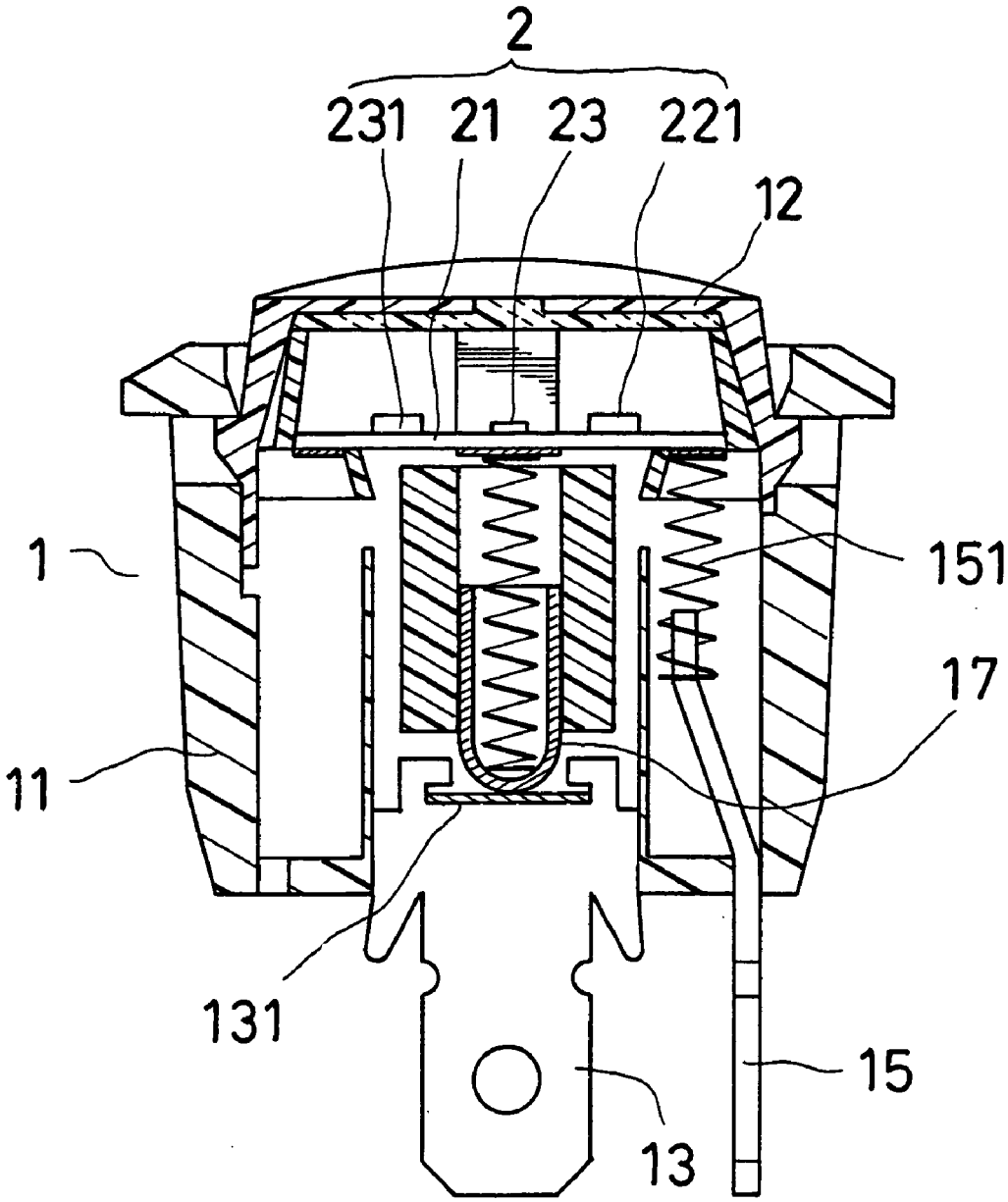
FIG. 2 is another vertical section of the switch of the present invention, which is parallel to the front side.

The indicating lamp assembly 2 is disposed in the control element 12 such that the common leg of the lamps 22 and 23 are connected with the spring-loaded metallic member 17, and such that the electric resistance 221 touches an upper end of the elastic conducting element 151 of the third terminal 15 as shown in FIG. 2. And, the electric resistance 231 is arranged in such a position that when the switch main body 1 is switched to the closed position, the electric resistance 231 will come into contact with the elastic conducting element 161, as shown in FIG. 3, and when the main body 1 is switched to the open position, the electric resistance 231 will be away from the conducting element 161.

Figure 4:
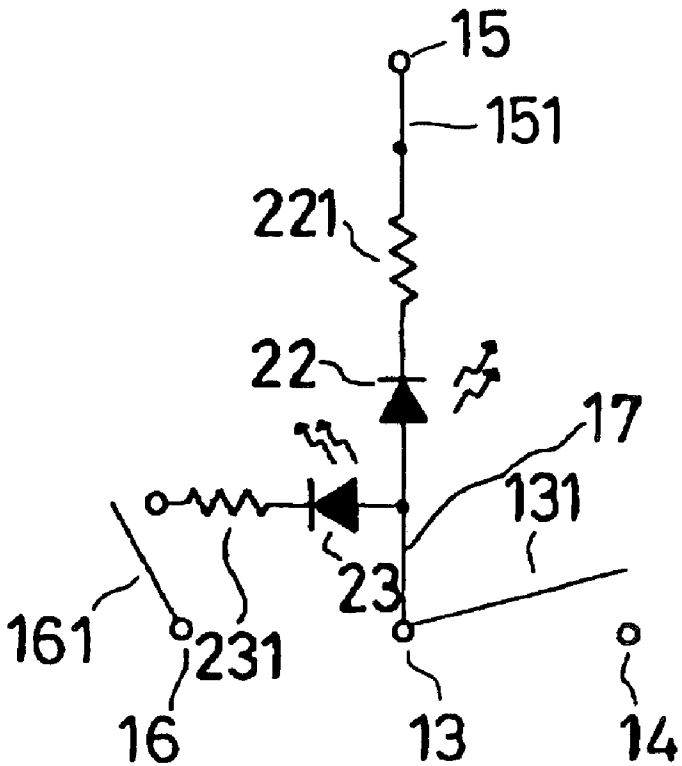
FIG. 4 is a circuit diagram of the present invention.
Figure 5:
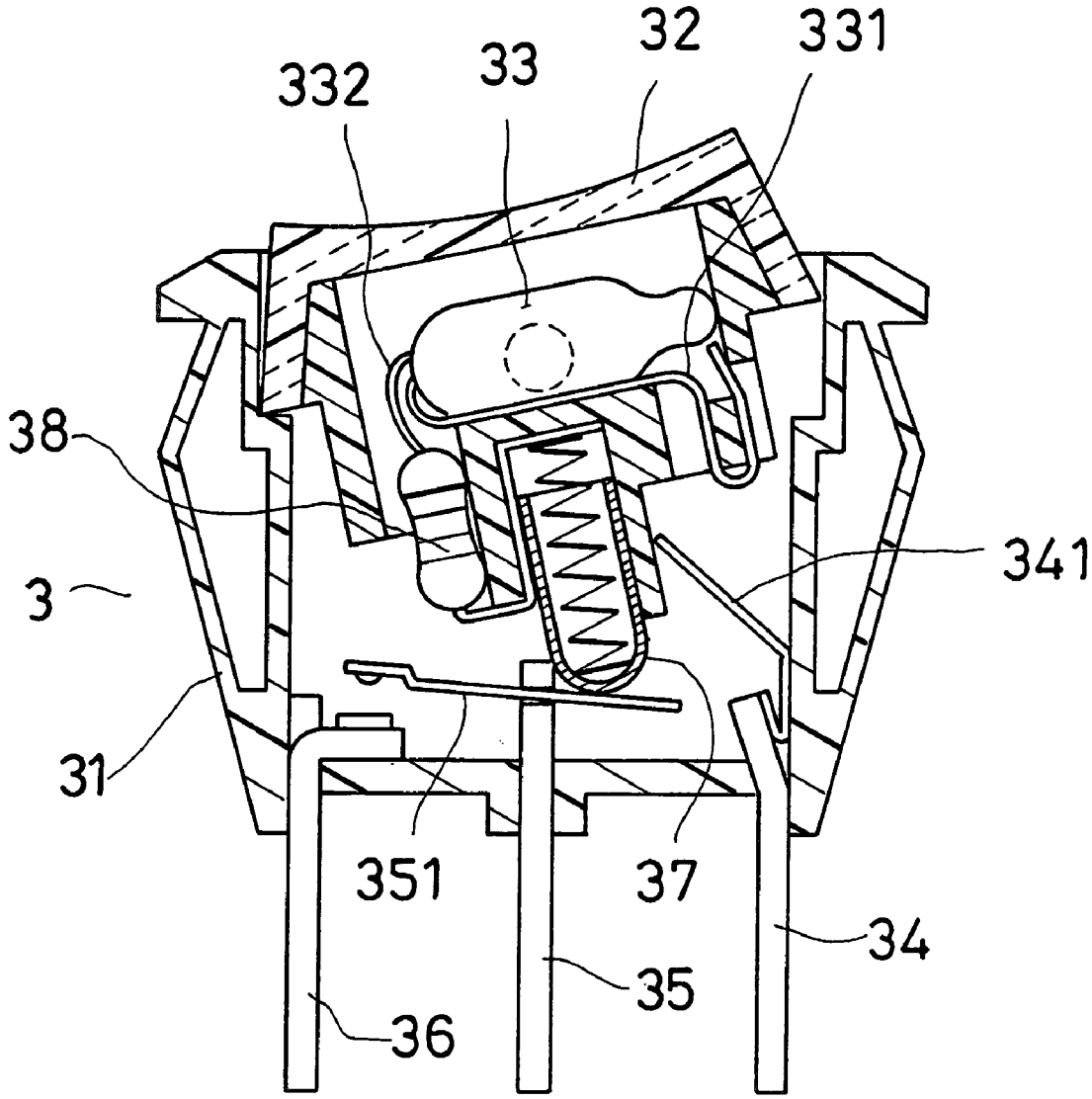
F I G. 5 (PRIOR ART)
FIG. 5 is a vertical section of the conventional switch in the open position.
Figure 6:
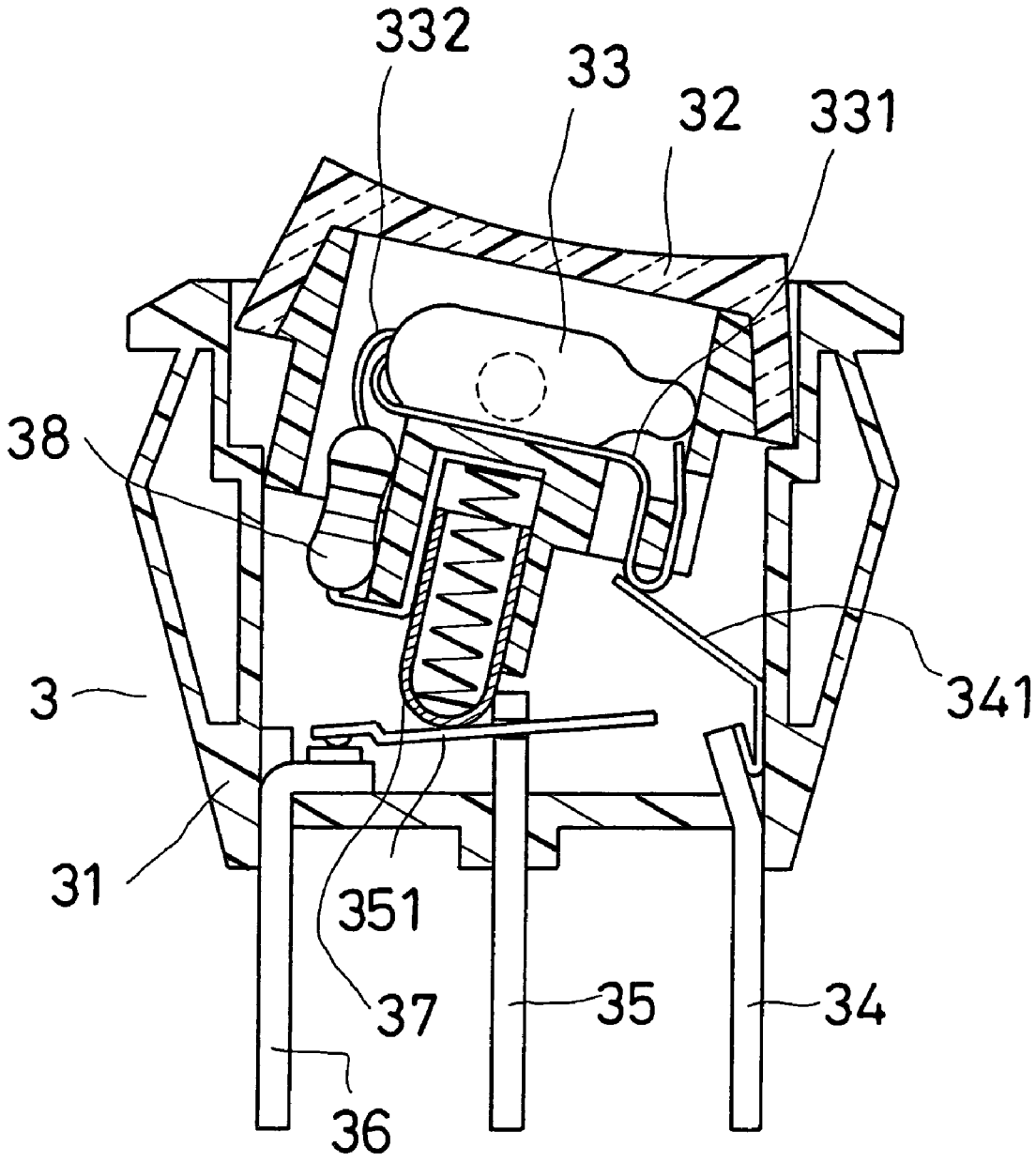
F I G. 6 (PRIOR ART)
FIG. 6 is a vertical section of the conventional switch in the closed position.

Consequently, the first indicating lamp 22 will be on, but the second indicating lamp 23 off when the switch main body 1 is in the open (off) position, as shown in FIGS. 1 and 4. Thus, people can easily find the present switch in the dark. And, the second indicating lamp 23 will be on as soon as the switch main body 1 is switched on, as shown in FIGS. 3 and 4. Thus, people can be informed that power is on.

From the above description, it can be understood that with the indicating lamp assembly, the switch of the present invention can be easily seen in the dark. And, when the switch is switched on, the second indicating lamp 23 will begin to produce light to inform people that power is on.

What is claimed is:

1. A switch, comprising:

a housing;

a control element pivotally coupled to an upper portion of the housing;

a first terminal, a second terminal, a third terminal, and a fourth terminal extending out from a lower portion of the housing, the first terminal having a conducting plate pivoted to an upper end thereof for separable contact with the second terminal, the switch being in a closed state when the conducting plate contacts the second terminal and the switch being in an open state when the conducting plate is displaced out of contact with the second terminal;

a spring-loaded metallic member secured to a lower side of the control element for displacement therewith, the spring-loaded metallic member being in contact with the conducting plate of the first terminal and displacing the conducting plate in and out of contact responsive to pivotal displacement of the control element;

a pair of elastic conducting elements respectively extending from the third and fourth terminals; and, an indicating lamp assembly disposed in the housing, the indicating lamp assembly including:

a. a first indicating lamp for identifying the switch to a user in darkness;

b. a second indicating lamp for indicating to a user that the switch is in the closed state, each of the first and second lamps having a respective first end electrically connected to the spring-loaded metallic member;

c. a first resistance coupled between the elastic conducting element of the third terminal and a second end of the first lamp; and d. a second resistance coupled between a second end of the second lamp and the elastic element of the fourth terminal when the switch is in a closed state;

whereby the first indicating lamp is on and the second indicating lamp is off when the switch is in the open state, the second indicating lamp being energized responsive to the switch being in the on state.

2. The switch as claimed in claim 1, wherein the indicating lamp assembly includes a circuit board mounted to the control element for pivotal displacement therewith, each of the first and second indicating lamps being mounted to the circuit board.

* * * * *